US010481523B2

(12) United States Patent
Nishimura

(10) Patent No.: US 10,481,523 B2
(45) Date of Patent: Nov. 19, 2019

(54) IMAGE FORMING APPARATUS AND IMAGE FORMING SYSTEM

(71) Applicant: KYOCERA Document Solutions Inc., Osaka (JP)

(72) Inventor: Jun Nishimura, Osaka (JP)

(73) Assignee: Kyocera Document Solutions, Inc. (JP)

( * ) Notice: Subject to any disclaimer, the term of this patent is extended or adjusted under 35 U.S.C. 154(b) by 0 days.

(21) Appl. No.: 15/985,025

(22) Filed: May 21, 2018

(65) Prior Publication Data

US 2018/0341194 A1 Nov. 29, 2018

(30) Foreign Application Priority Data

May 23, 2017 (JP) ..... 2017-102170

(51) Int. Cl.
*G03G 15/00* (2006.01)
*G03G 15/08* (2006.01)
*G03G 21/18* (2006.01)

(52) U.S. Cl.
CPC ..... *G03G 15/0849* (2013.01); *G03G 15/0863* (2013.01); *G03G 15/0872* (2013.01); *G03G 15/55* (2013.01); *G03G 15/5016* (2013.01); *G03G 21/1892* (2013.01)

(58) Field of Classification Search
CPC ..... G03G 15/0863; G03G 21/1896; G03G 21/1647; G03G 15/0865; G03G 15/55
USPC ..... 399/12
See application file for complete search history.

(56) References Cited

U.S. PATENT DOCUMENTS 6,173,130 B1 * 1/2001 Oguma ..... G03G 15/0822 399/254
2015/0355012 A1 * 12/2015 Gurumohan ..... A47G 19/00 702/55

FOREIGN PATENT DOCUMENTS

JP 2000-246921 9/2000

OTHER PUBLICATIONS

Ultra_vs_Infrared_IR_Sensors.pdf. Nov. 27, 2017, Roderick Burnett.*

* cited by examiner

*Primary Examiner* — Clayton E. LaBalle
*Assistant Examiner* — Frederick Wenderoth

(57) ABSTRACT

An image forming apparatus includes a printing device, an ultrasonic sensor, and a controller. The printing device to which a toner container is mounted is configured to perform printing using toner in the toner container. The ultrasonic sensor arranged so as to correspond to a mounting position of the toner container is configured to (a) output an ultrasonic wave to a specific position of the toner container, (b) detect the ultrasonic wave that passes through the toner container, and (c) output a detection signal corresponding to an intensity of the detected ultrasonic wave. The controller is configured to determine whether the toner container is a genuine product or not on the basis of a level of the detection signal of the ultrasonic sensor when the toner container is mounted.

6 Claims, 4 Drawing Sheets

IMAGE FORMING APPARATUS AND IMAGE FORMING SYSTEM

CROSS-REFERENCE TO RELATED APPLICATIONS

This application relates to and claims priority rights from Japanese Patent Application No. 2017-102170, filed on May 23, 2017, the entire disclosures of which are hereby incorporated by reference herein.

BACKGROUND

1. Field of the Present Disclosure

The present disclosure relates to an image forming apparatus and an image forming system.

2. Description of the Related Art

In a consumable supply system, a cartridge includes an IC (Integrated Circuit) chip in which its identification information or the like has been memorized, and a main body device acquires the identification information from the IC chip, and confirms that the cartridge is a genuine product.

However, if a copy product or the like of a genuine product of the IC chip is mounted in a non-genuine toner container, the non-genuine toner container is improperly detected as a genuine product.

SUMMARY

An image forming apparatus according to an aspect of the present disclosure includes a printing device, an ultrasonic sensor, and a controller. The printing device to which a toner container is mounted is configured to perform printing using toner in the toner container. The ultrasonic sensor arranged so as to correspond to a mounting position of the toner container is configured to (a) output an ultrasonic wave to a specific position of the toner container, (b) detect the ultrasonic wave that passes through the toner container, and (c) output a detection signal corresponding to an intensity of the detected ultrasonic wave. The controller is configured to determine whether the toner container is a genuine product or not on the basis of a level of the detection signal of the ultrasonic sensor when the toner container is mounted.

An image forming system according to an aspect of the present disclosure includes the aforementioned image forming apparatus and the aforementioned toner container.

These and other objects, features and advantages of the present disclosure will become more apparent upon reading of the following detailed description along with the accompanied drawings.

DETAILED DESCRIPTION

Hereinafter, an embodiment according to an aspect of the present disclosure will be explained with reference to drawings.

Figure 1:
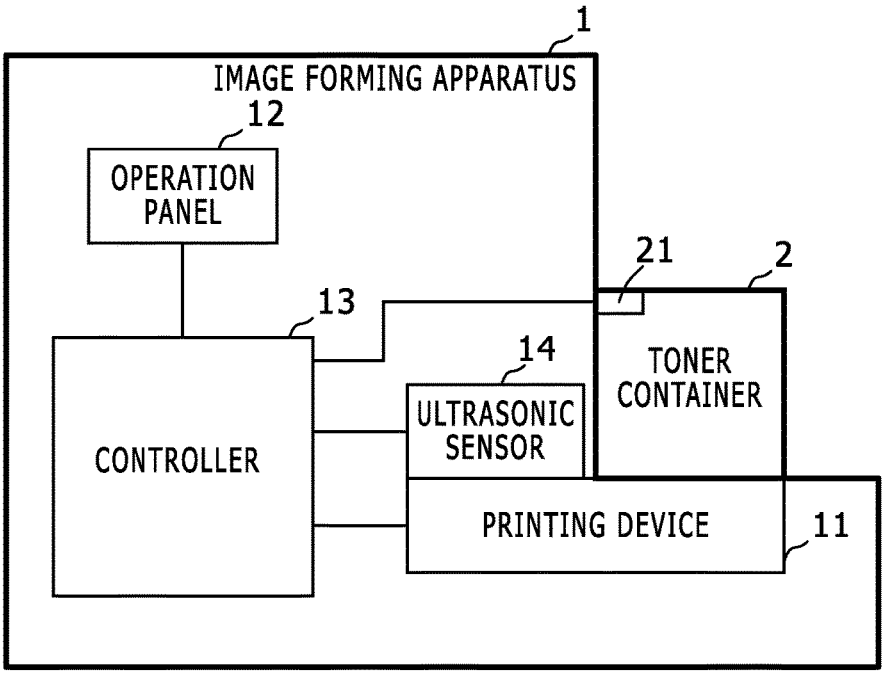
FIG. 1 shows a block diagram that indicates a configuration of an image forming system in an embodiment of the present disclosure.

FIG. 1 shows a block diagram that indicates a configuration of an image forming system in an embodiment of the present disclosure. The image forming system shown in FIG. 1 includes an image forming apparatus 1, for example, of an electrophotographic method, and a toner container 2 enabled to be mounted to the image forming apparatus 1.

The image forming apparatus 1 is a printer, a multi function peripheral or the like, and includes a printing device 11, an operation panel 12, a controller 13, and an ultrasonic sensor 14.

The printing device 11 includes a photoconductor drum, an exposure device, a development device, a fuser and the like (not shown); forms an electrostatic latent image on the photoconductor drum using the exposure device; forms a toner image by attaching toner to the electrostatic latent image using the development device, transfers the toner image onto a printing paper sheet and thereafter fixes the toner image on the printing paper sheet using the fuser; and thereby performs printing.

In the toner container 2, an inside toner storage part is filled with toner, the toner container 2 is mounted to the printing device 11 of the image forming apparatus 1, and the printing device 11 uses the toner in the toner container and thereby forms a toner image and performs printing. Consequently, when toner is exhausted in the toner container 2, the toner container 2 is replaced with a toner container filled with toner. Therefore, the toner container 2 is enabled to be mounted and demounted to the image forming apparatus 1.

The operation panel 12 includes a display device that displays sorts of information to a user and an input device that receives a user operation. For example, the display device includes a liquid crystal display, some indicators and/or the like. Further, for example, the input device includes a touch panel, a hard key and/or the like.

The controller 13 includes a micro computer, an ASIC (Application Specific Integrated Circuit) and/or the like, displays an operation screen on the display device of the operation panel 12, displays sorts of messages to a user on the display device, and controls the printing device 11 in accordance with a user operation performed to the input device of the operation panel 12 and thereby causes the printing device 11 to perform printing.

Figure 2:
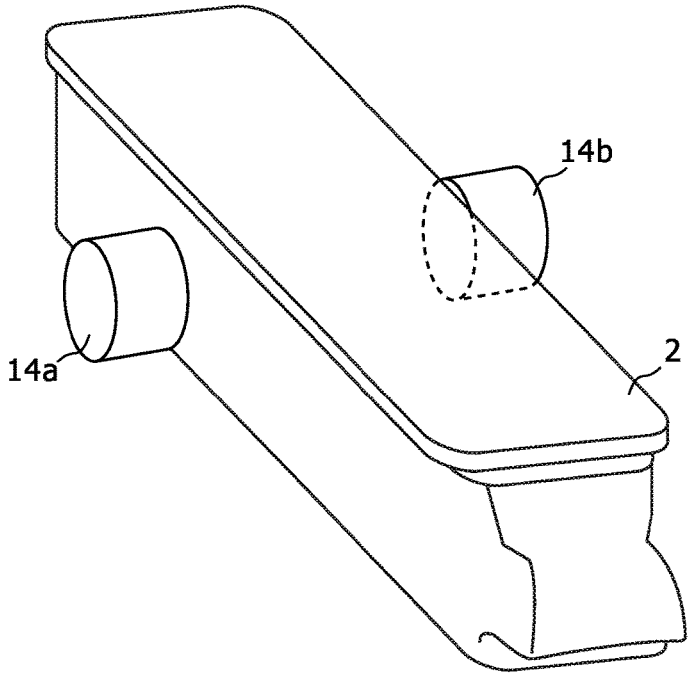
FIG. 2 shows a perspective view diagram that indicates an example of a position of an ultrasonic sensor 14.

FIG. 2 shows a perspective view diagram that indicates an example of a position of the ultrasonic sensor 14.

As shown in FIG. 2, the ultrasonic sensor 14 includes an oscillator 14*a* and a receiver 14*b*. The ultrasonic sensor 14 is arranged so as to correspond to a mounting position of the toner container 2 as shown in FIG. 2, and (a) outputs an ultrasonic wave to a specific position of the toner container 2 using the oscillator 14*a*, (b) detects the ultrasonic wave that passes through the toner container 2 using the receiver 14*b*, and (c) outputs a detection signal corresponding to an intensity of the detected ultrasonic wave.

Upon mounting the toner container 2, the controller 13 determines whether the toner container 2 is a genuine product or not on the basis of a level of the detection signal of the ultrasonic sensor 14.

For example, the toner container 2 includes a resin made housing. The housing of the toner container 2 at a specific position has a thickness corresponding to production timing of the toner container 2. Further, an IC chip 21 is mounted in the toner container 2, and in the IC chip 21, identification information of the toner container 2 and the production timing of the toner container 2 has been memorized.

The aforementioned specific position of the toner container 2 is a position other than a toner storage part of the toner container 2. Consequently, a level of the detection signal of the ultrasonic sensor 14 does not change due to decrement of a toner amount in the toner container 2.

For example, when production (mass production) start timing of toner containers that have a same type of this toner container 2 is referred as X0 and a year of the production timing of this toner container 2 is referred as X, and a month of the production timing of this toner container 2 is referred as Y, the thickness W at the specific position is set as W=Y+0.1*(X−X0) millimeters, for example. In such a case, for example, if the production start timing is January of 2014, then the thickness W at the specific position of the toner container 2 manufactured in December of 2016 is set as 12.2 (=12+0.1*2) millimeters.

Therefore, the ultrasonic sensor 14 outputs the detection signal that has a level corresponding to the aforementioned thickness W. The controller 13 receives the detection signal of the ultrasonic sensor 14; and if a level of the detection signal of the ultrasonic sensor 14 is a level corresponding to a time point within a production term of the toner container 2, the controller 13 determines that the toner container 2 is a genuine product, and otherwise, if not, the controller 13 determines that the toner container 2 is not a genuine product.

A relationship between a level of the detection signal and the production timing (or the thickness at the specific position) is determined in an experiment or the like in advance, and the controller 13 performs the aforementioned determination using data of this relationship.

Figure 3:
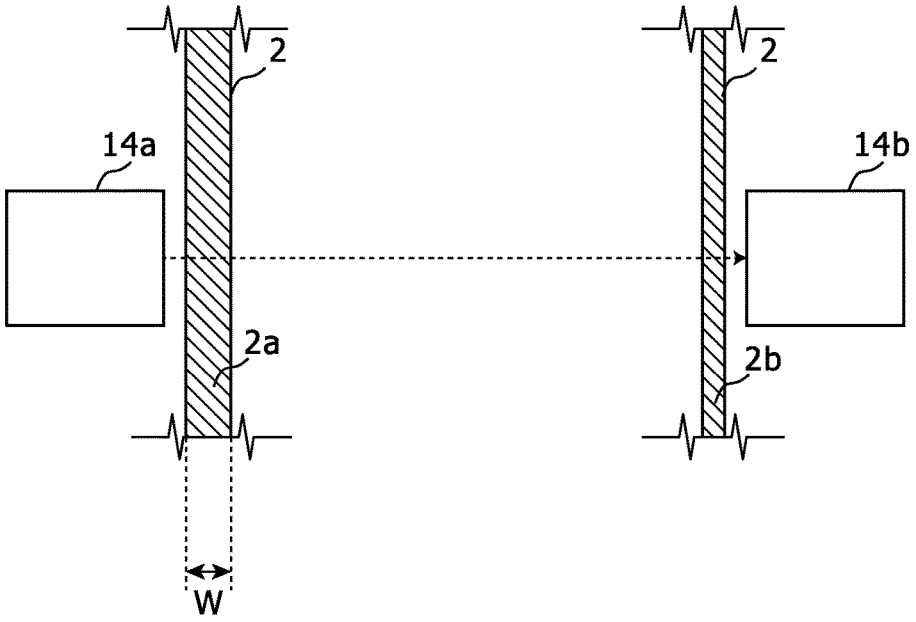
FIG. 3 shows a diagram that explains a thickness at a specific position of an outer wall of a toner container 2 shown in FIG. 1.

FIG. 3 shows a diagram that explains a thickness at a specific position of an outer wall of the toner container 2 shown in FIG. 1. For example, as shown in FIG. 3, one or both of outer walls 2*a* and 2*b* at the specific position of the housing of the toner container 2 has/have a thickness W corresponding to production timing of the toner container 2.

Figure 4:
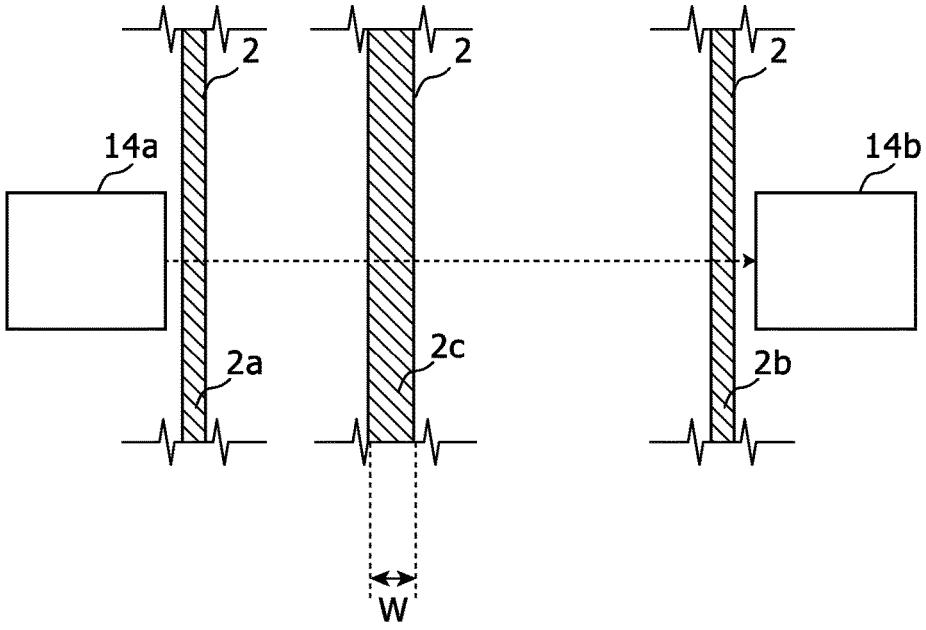
FIG. 4 shows a diagram that explains a thickness at a specific position of an inner wall of a toner container 2 shown in FIG. 1.

FIG. 4 shows a diagram that explains a thickness at a specific position of an inner wall of the toner container 2 shown in FIG. 1. Otherwise, for example, an inner wall 2*c* at the specific position of the housing of the toner container 2 has a thickness W corresponding to production timing of the toner container 2.

Here, the aforementioned thickness is formed so as not to enable to be recognized from its exterior appearance, for example, by making an inner surface of the toner container 2 as a concave shape or a convex shape. Further, for any production timing, the aforementioned thickness at the specific position may be set as a thickness different from a thickness of a surrounding area of the specific position.

Furthermore, in this embodiment, if the controller 13 successfully reads production timing of the toner container 2 from the IC chip 21 mounted in the toner container 2, then the controller 13 determines production timing of the toner container 2 on the basis of a level of the detection signal of the ultrasonic sensor 14, and compares the determined production timing with the read production timing, and thereby determines whether the toner container 2 is a genuine product or not. Specifically, if the determined production timing agrees with the read production timing, then it is determined the toner container 2 is a genuine product.

Otherwise, if the controller 13 fails to read production timing of the toner container 2 from an IC chip 21 mounted in the toner container 2 (including a case that the IC chip 21 does not exist), then the controller 13 does not perform the determination on whether the toner container is a genuine product or not on the basis of the aforementioned detection signal.

The following part explains a behavior of the aforementioned image forming apparatus 1.

Upon mounting the toner container 2 to the printing device 11, the controller 13 firstly reads its identification information and its production timing from the IC chip 21 of the toner container 2.

If the controller 13 (provisionally) determines that the toner container 2 is a genuine product on the basis of the identification information, then the controller 13 acquires the detection signal of the ultrasonic sensor 14, and determines the production timing corresponding to the detection signal.

Subsequently, if the production timing corresponding to the detection signal falls within the production term and agrees with the production timing read from the IC chip 21, then the controller 13 determines that the toner container 2 is a genuine product. Otherwise, if not, the controller 13 determines the toner container 2 is not a genuine product.

If the controller 13 fails to acquire the identification information and/or the production timing from the IC chip 21 of the toner container 2, then the controller 13 does not perform the determination on whether the toner container 2 is a genuine product or not on the basis of the aforementioned detection signal. Here, if the controller 13 fails to acquire the identification information and/or the production timing from the IC chip 21 of the toner container 2, then the controller 13 determines that the toner container 2 is not a genuine product, regardless of the aforementioned thickness at the specific position.

As mentioned, in the present embodiment, the ultrasonic sensor 14 is arranged so as to correspond to a mounting position of the toner container 2, and (a) outputs an ultrasonic wave to a specific position of the toner container 2, (b) detects the ultrasonic wave that passes through the toner container 2, and (c) outputs a detection signal corresponding to an intensity of the detected ultrasonic wave. Upon mounting the toner container 2, the controller 13 determines whether the toner container 2 is a genuine product or not on the basis of a level of the detection signal of the ultrasonic sensor 14.

Consequently, it is restrained that a non-genuine toner container is improperly detected as a genuine product.

It should be understood that various changes and modifications to the embodiments described herein will be apparent to those skilled in the art. Such changes and modifications may be made without departing from the spirit and scope of the present subject matter and without diminishing its intended advantages. It is therefore intended that such changes and modifications be covered by the appended claims.

For example, in the aforementioned embodiment, the controller 13 determines production timing of the toner container on the basis of a level of the detection signal of the ultrasonic sensor, and may notify a user of a usage expiration time point (i.e. a time point obtained by adding a predetermined usable time to the production timing) corresponding to the determined production timing or of a residual time until the usage expiration time point.

Further, in the aforementioned embodiment, when the controller 13 determines that the toner container 2 is a genuine product upon mounting the toner container 2, the controller 13 may not perform the determination on whether this toner container 2 is a genuine product or not on the basis of the aforementioned detection signal, afterward, until this toner container 2 is demounted. Consequently, the ultrasonic sensor 14 gets a low usage frequency and therefore gets a long life time.

What is claimed is:

1. An image forming apparatus, comprising:

a printing device to which a toner container is mounted, and configured to perform printing using toner in the toner container;

an ultrasonic sensor arranged so as to correspond to a mounting position of the toner container, and configured to (a) output an ultrasonic wave to a specific position of the toner container, (b) detect the ultrasonic wave that passes through the toner container, and (c) output a detection signal corresponding to an intensity of the detected ultrasonic wave; and a controller configured to determine whether the toner container is a genuine product or not on the basis of a level of the detection signal of the ultrasonic sensor when the toner container is mounted wherein a housing of the toner container has at a specific position a thickness corresponding to production timing of the toner container;

the ultrasonic sensor outputs the detection signal of a level corresponding to the thickness; and the controller (a) determines that the toner container is a genuine product if a level of the detection signal of the ultrasonic sensor is a level corresponding to a time point within a production term of the toner container; and (b) determines that the toner container is not a genuine product if a level of the detection signal of the ultrasonic sensor is not a level corresponding to any time point within a production term of the toner container.

2. An image forming system, comprising:

an image forming apparatus; and a toner container;

wherein the image forming apparatus comprises:

a printing device to which a toner container is mounted, and configured to perform printing using toner in the toner container;

an ultrasonic sensor arranged so as to correspond to a mounting position of the toner container, and configured to (a) output an ultrasonic wave to a specific position of the toner container, (b) detect the ultrasonic wave that passes through the toner container, and (c) output a detection signal corresponding to an intensity of the detected ultrasonic wave; and a controller configured to determine whether the toner container is a genuine product or not on the basis of a level of the detection signal of the ultrasonic sensor when the toner container is mounted;

wherein a housing of the toner container has at a specific position a thickness corresponding to production timing of the toner container;

the ultrasonic sensor outputs the detection signal of a level corresponding to the thickness; and the controller (a) determines that the toner container is a genuine product if a level of the detection signal of the ultrasonic sensor is a level corresponding to a time point within a production term of the toner container; and (b) determines that the toner container is not a genuine product if a level of the detection signal of the ultrasonic sensor is not a level corresponding to any time point within a production term of the toner container.

3. The image forming apparatus according to claim 1 wherein one or both of outer walls at a specific position of a housing of the toner container or an inner wall at a specific position of the housing of the toner container has/have a thickness corresponding to production timing of the toner container.

4. The image forming apparatus according to claim 1 wherein if the controller successfully reads production timing of the toner container from an IC chip mounted in the toner container, the controller determines production timing of the toner container on the basis of a level of the detection signal of the ultrasonic sensor, compares the determined production timing with the read production timing, and thereby determines whether the toner container is a genuine product or not; and if the controller fails to read production timing of the toner container from an IC chip mounted in the toner container, the controller does not determine whether the toner container is a genuine product or not.

5. The image forming apparatus according to claim 1 wherein the controller (a) determines production timing of the toner container on the basis of a level of the detection signal of the ultrasonic sensor, (b) notifies a user of a usage expiration time point corresponding to the determined production timing or of a residual time until the usage expiration time point.

6. The image forming apparatus according to claim 1 wherein the specific position of the toner container is a position other than a toner storage part of the toner container.

* * * * *